US005561832A

United States Patent [19]

Hyung-Sik et al.

[11] Patent Number: 5,561,832

[45] Date of Patent: Oct. 1, 1996

[54] METHOD FOR MANUFACTURING VANADIUM CARBIDE POWDER ADDED TOOL STEEL POWDER BY MILLING PROCESS, AND METHOD FOR MANUFACTURING PARTS THEREWITH

[75] Inventors: Chung Hyung-Sik; Bae Jong-Su; Kim Young-Jin, all of Changwon-Si, Rep. of Korea

[73] Assignee: Korea Institute of Machinery & Metals, Rep. of Korea

[21] Appl. No.: 496,459

[22] Filed: Jun. 29, 1995

[30] Foreign Application Priority Data

Jul. 4, 1994 [KR] Rep. of Korea ..... 94-15938

[51] Int. Cl.[6] ..... B22F 9/00; B22F 1/00; B22F 3/12

[52] U.S. Cl. ..... 419/14; 419/28; 419/29; 419/31; 419/32; 419/33; 419/38; 419/53; 419/62; 75/351; 75/352

[58] Field of Search ..... 419/14, 28, 29, 419/31, 32, 33, 38, 53, 60; 75/351, 352

[56] References Cited

U.S. PATENT DOCUMENTS

| | | | |
|---|---|---|---|
| 3,785,801 | 1/1974 | Benjamin | 75/255 |
| 4,002,503 | 1/1977 | Bourne et al. | 148/514 |
| 5,081,760 | 1/1992 | Kikuhira et al. | 29/130 |
| 5,238,482 | 8/1993 | Stasko et al. | 75/338 |
| 5,328,500 | 7/1994 | Beltz et al. | 75/343 |
| 5,344,477 | 9/1994 | Stasko et al. | 75/255 |

*Primary Examiner*—Charles T. Jordan
*Assistant Examiner*—Daniel Jenkins
*Attorney, Agent, or Firm*—Adams & Wilks

[57] ABSTRACT

A tool steel powder added with a vanadium carbide powder by a milling process, and a method for manufacturing parts therewith are disclosed. Particularly, a method for adding a vanadium carbide (VC) powder to a tool steel powder by a ball milling or an attrition milling, and a method for manufacturing a part by using the milled tool steel powder are disclosed. The method for manufacturing a vanadium carbide added tool steel powder and for manufacturing parts using the powder, includes the steps of: mixing a tool steel powder with vanadium carbide powder in an amount of 5~15 wt %; ball-milling the mixture powder under wet atmosphere; carrying out an annealing in a vacuum; carrying out a cold die compaction or cold isostatic pressing to near net dimension and carrying out a vacuum sintering and then a hot isotropic pressing without canning.

19 Claims, 3 Drawing Sheets

METHOD FOR MANUFACTURING VANADIUM CARBIDE POWDER ADDED TOOL STEEL POWDER BY MILLING PROCESS, AND METHOD FOR MANUFACTURING PARTS THEREWITH

FIELD OF THE INVENTION

The present invention relates to tool steel powders added with vanadium carbide by milling process, and a manufacturing method therewith. Particularly, the present invention relates to a method for adding vanadium carbide(VC) powder to tool steel powders by utilizing a ball milling or attrition milling, and to a method for manufacturing parts from these powders.

BACKGROUND OF THE INVENTION

The tool steels manufactured by powder metallurgical processes have superior mechanical properties compared with those manufactured by the conventional wrought process. The application of the sintering process in manufacturing wear parts from tool steel powders makes it possible to save the process cost. But rigorous sintering conditions are required to make a part having good mechanical properties, and therefore, a serious problem is encountered in putting it to the practical use.

SUMMARY OF THE INVENTION

The object of the present invention is to provide a process for manufacturing a highly wear resistant part by a sintering process and by improving the density after the mixing the existing tool steel powder with the highly wear resistant vanadium carbide(VC) powder.

BRIEF DESCRIPTION OF THE DRAWINGS

The above object and other advantages of the present invention will become more apparent by describing in detail the preferred embodiment of the present invention with reference to the attached drawings in which:

FIG. 2 is a photograph showing the sintered structures of test pieces with vanadium carbide added to the M2 powder, in which:

DESCRIPTION OF THE PREFERRED EMBODIMENT

Figure 1:
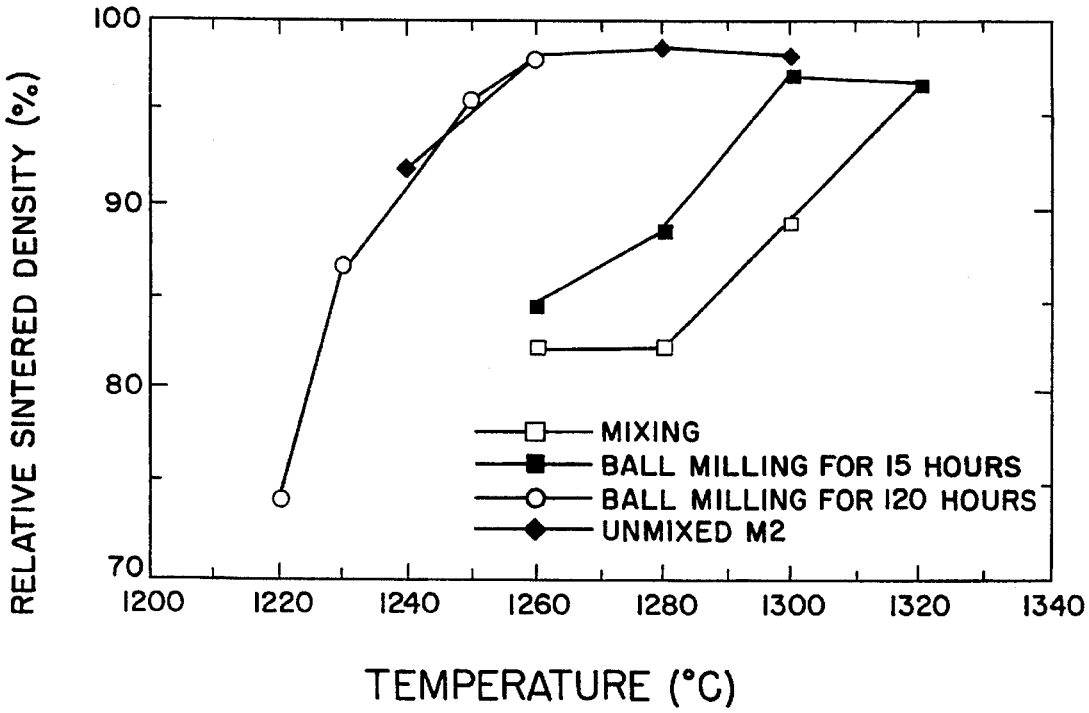
FIG. 1 is a graphical illustration showing the variation of the relative sintered density versus milling time in carrying out the method of adding vanadium carbide to an M2 powder.

A simple mixture of a tool steel powder and vanadium carbide powder requires a high sintering temperature to get fully dense parts and also has inferior mechanical properties than wrought steel. However, if a tool steel and fine vanadium carbide powder are ball milled for a long time, the vanadium carbide is finely dispersed or embedded in the tool steel powder. After a proper annealing and cold compaction to desired shape, the powder compacts can be sintered to high density with fine grain and carbide structure at a lower temperature than that of the simply mixed powder. Further, the residual pores can be eliminated completely by applying a hot isostatic pressing(HIP) without canning and highly wear resistant parts are obtained after heat treatment.

<Powder Milling>

The tool steel powder and vanadium carbide powder are measured in a proper ratio, and are mixed together. The mixture is filled into a ball milling jar with balls. In order to prevent the decarburization and oxidation of the powder during the ball milling, the ball milling is conducted under a wet atmosphere(in hexane). The time period for the ball milling is properly adjusted in accordance with the size of the jar and ball, the volume, of the powder and ball.

<Sintering of the Ball-milled Powder>

The balled-milled powder has been hardened by the cold working during the milling and therefore, an annealing is carried out so as to make it possible to carry out a cold compaction.

Generally, the annealing is carried out under a vacuum atmosphere. The annealing condition is slightly different depending on the type of the powder, but generally, the powder is heated to 800°~900° C. and holding for one or two hours and then cooled slowly to room temperature.

<Compaction, Sintering and Eliminating of Residual Pores>

The product of the present invention can be fabricated by using a cold compaction die or a cold isotropic pressing method, and during the compaction, a lubricant is added in the amount of 0.5~1 wt % for improving the compactability. The product thus compacted is heated to a temperature of 500°~600° C. under a partially reducing atmosphere to remove the lubricant. Then it is sintered at a proper temperature between 1220° C. and 1300° C. in a vacuum of $10^{-2}$ torr or lower. In order to remove the lubricant, a hot isotropic pressing without canning is carried out with the conditions of 1000°~1200° C., 1000°~1500° C. bars for 1~3 hours under argon atmosphere.

<Heat Treatment>

The heat treatment for improving the mechanical properties of the product is carried in a manner similar to that of the wrought tool steel. The product is heated to above austenizing temperature, held for a proper time, and then oil-quenched or air-cooled. Then a tempering is conducted two or three times at a temperature of 500°~600° C., thereby obtaining the final product.

EXAMPLE

The M2 grade tool steel powder, which is most widely used, and which is composed of 0.95C, 3.9Cr, 6.2W, 4.5Mo, 1.8V, and balance of Fe, was mixed with a vanadium carbide powder having an average particle size of 1.6 μm. Five kinds of powders were prepared as described below.

Powder 1: M2-10 wt % VC (simple mixing by a V-blender for 30 minutes).

Powder 2: M2-5 wt % VC (ball-milled for 15 hours).

Powder 3: M2-10 wt % VC (ball-milled for 120 hours).

Powder 4: M2-10 wt % VC (ball-milled for 120 hours).

Powder 5: M2-15 wt % VC (ball-milled for 120 hours).

The ball-milling was carried out based on a wet method (in hexane), and after the ball milling, an annealing was carried out at a temperature of 900° C. for one hour under a vacuum atmosphere of below $10^{-2}$ torr. After carrying out the annealing, a cold die compaction and a cold isotropic pressing (CIP) were carried out, thereby obtaining rectangular test pieces of 10×10×50 min. The test pieces thus prepared were subjected to sintering at various temperatures between 1220°~ 1320° C. under a vacuum atmosphere of below $10^{-2}$ torr.

Figure 2A:
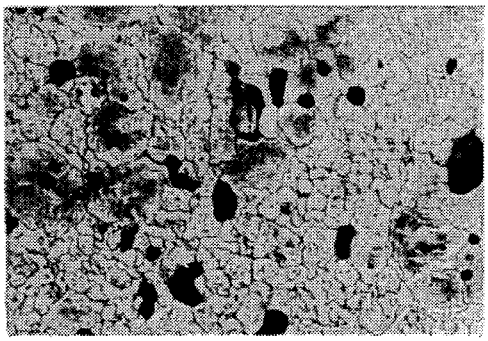
FIG. 2*a* shows an M2-10 wt % VC test piece from a powder simply mixed by V-blender and sintered at 1280° C.
Figure 2B:
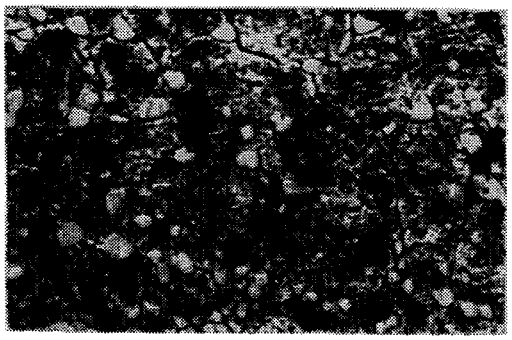
FIG. 2*b* shows an M2-5 wt % VC test piece from a powder prepared by a ball milling for 120 hours and sintered at 1260° C.
Figure 2C:
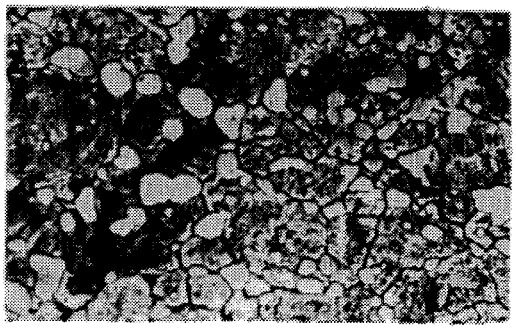
FIG. 2*c* shows an M2-10 wt % test piece from a powder prepared by a ball milling for 120 hours and sintered at 1240° C.
Figure 2D:
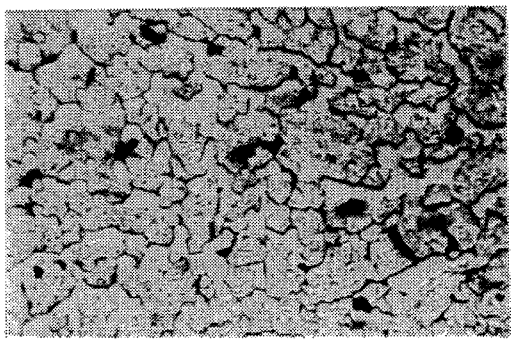
FIG. 2*d* shows an M2-15 wt % VC test piece from a powder prepared by a ball milling for 120 hours and sintered at 1240° C.

FIG. 1 illustrates relative sintered density (sintered density/theoretical density ×100), and this drawing shows that a high relative density can be obtained at a low sintering temperature as the ball-milling time period is increased, compared with the simply mixed powder by a V-blender (FIG. 2*a*), a large amount of residual pores remain even after the sintering at higher temperature. However, in the test pieces where the ball milling is carried out for 120 hours (FIG. 2*b*, 2*c* and 2*d*), most of the pores have been removed in spite of the lower sintering temperature. Therefore, in the case of the simple mixing, the hot isostatic pressing (HIP) to get full density cannot be carried out without canning. Also, such powder have nonhomogeneous carbide structure which is the cause of the poor mechanical properties. On the other hand, in the case of the present invention, the HIP can be carried out without canning.

After the sintering, the powder 1 was first subjected to a canning, and then, subjected to the HIP at a temperature of 1100° C. under a pressure of 1500 bar for 2 hours, while the powders 3, 4 and 5 were subjected to the HIP without canning at 1100° C. and under 1500 bar for 2 hours immediately after the sintering.

Figure 3A:
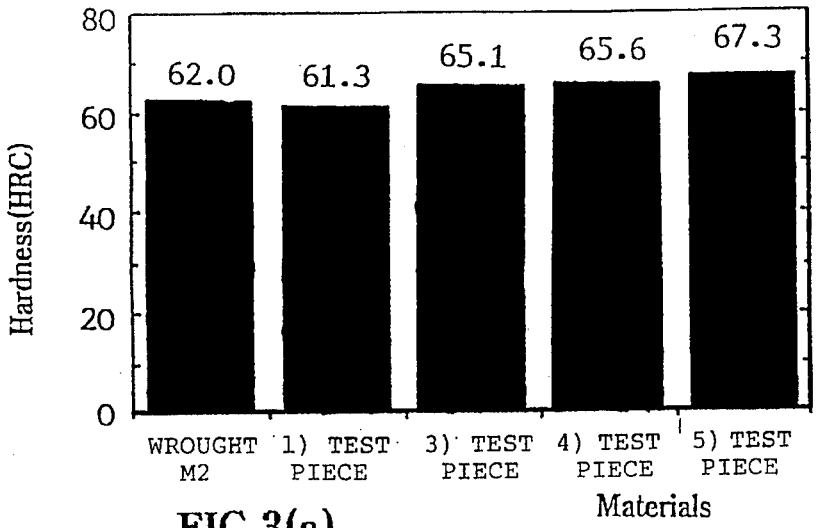
FIG. 3 illustrates comparisons of hardness (FIG. 3*a*), bending strength (FIG. 3*b*) and wear rate (FIG. 3*c*) among the wrought M2, the simple mixed material and the materials of the present invention.
Figure 3B:
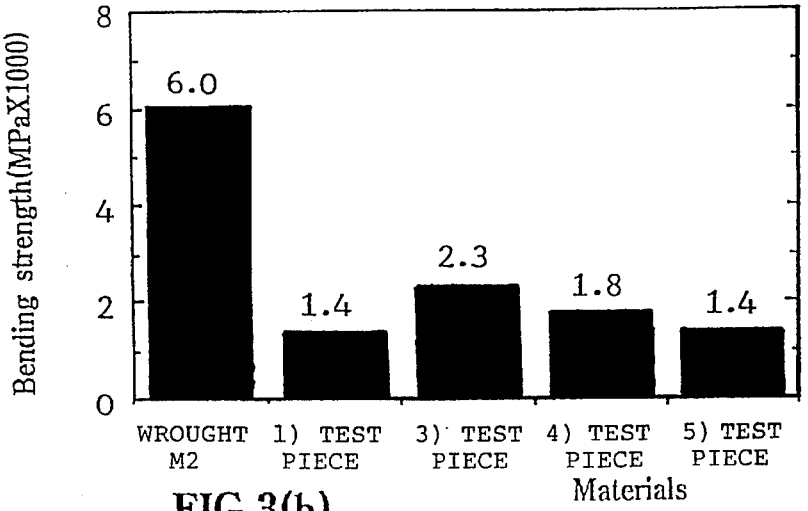
Figure 3C:
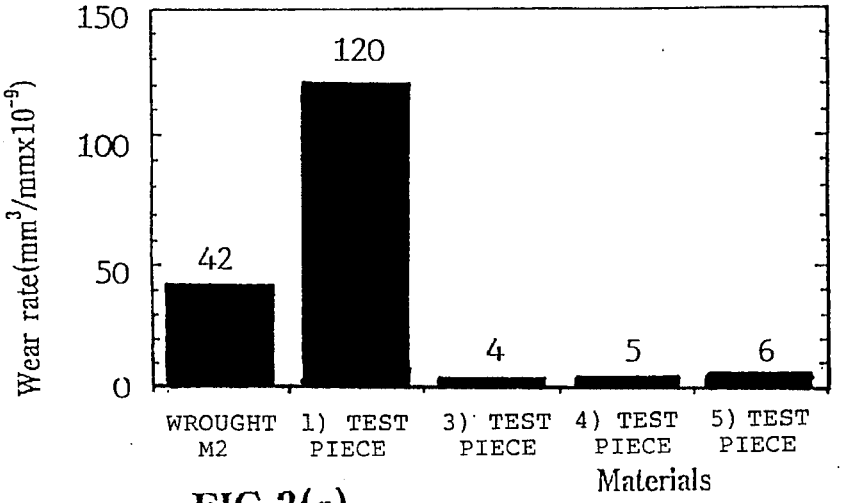

FIG. 3 compares the hardness, the bending strength and the wear rate of the final test pieces of a conventional wrought material and the powders 3, 4 and 5 of the present invention. In the case of the powders 3, 4 and 5 which were produced in accordance with the present invention, hardness was higher than the comparative materials under the same heat treating conditions (FIG. 3*a*). The bending strength of the test pieces of the present invention was lower by about ⅓ that of the wrought material (FIG. 3*b*). The reason is that the hardness of the material of the present invention is higher than that of the comparative materials, and the materials of the present invention include a large amount of vanadium carbide.

Meanwhile, the wearing amount in the present invention (FIG. 3*c*) was smaller by about 1/7~1/10 compared with the melt casting material.

According to the present invention as described above, highly wear resistant parts can be manufactured to near net dimension in which finely dispersed VC particles improve the wear resistance.

What is claimed is:

1. A method for manufacturing a tool steel powder having a vanadium carbide content in the range of 5 to 15 wt % comprising the steps of: mixing a tool steel powder with 5–15 wt % of a vanadium carbide powder; and ball-milling the mixture for a time period sufficient to prevent degradation of the mechanical properties of a part produced with the tool steel powder due to the addition of the vanadium carbide powder.

2. A method for manufacturing a tool steel powder according to claim 1; wherein the vanadium carbide powder is added in the amount of 5 wt % and the mixture is ball milled for approximately 120 hours.

3. A method for manufacturing a tool steel powder according to claim 1; wherein the vanadium carbide powder is added in the amount of 10 wt % and the mixture is ball milled for approximately 120 hours.

4. A method for manufacturing a tool steel powder according to claim 1; wherein the vanadium carbide powder is added in the amount of 15 wt % and the mixture is ball milled for approximately 120 hours.

5. A method for manufacturing a tool steel powder according to claim 1; wherein the step of ball milling is conducted in a hexane atmosphere.

6. A method for manufacturing a tool steel powder according to claim 1; further comprising the step of annealing the ball-milled mixture in a vacuum at a temperature of 900° C. for one hour at a pressure no greater than $10^{-2}$ Torr.

7. A method of manufacturing a part from a tool steel powder having a vanadium carbide content comprising the steps of: mixing a tool steel powder with 5 wt % to about 15 wt % vanadium carbide powder; ball-milling the mixture for a time period sufficient to prevent degradation of the mechanical properties of a part produced with the tool steel powder due to the addition of the vanadium carbide powder; annealing the ball-milled mixture in a vacuum atmosphere; fabricating a part from the ball-milled mixture using a cold forming method; and performing a heat treatment for improving the mechanical properties of the part.

8. A method of manufacturing a part according to claim 1; wherein the vanadium carbide powder is added in the amount of 5 wt % and the mixture is ball milled for approximately 120 hours.

9. A method for manufacturing a part according to claim 7; wherein the vanadium carbide powder is added in the amount of 10 wt % and the mixture is ball milled for approximately 120 hours.

10. A method for manufacturing a part according to claim 7; wherein the vanadium carbide powder is added in the amount of 15 wt % and the mixture is ball milled for approximately 120 hours.

11. A method for manufacturing a part according to claim 7; wherein the step of ball milling is conducted in a hexane atmosphere.

12. A method for manufacturing a part according to claim 7; wherein the step of annealing is conducted at a temperature of approximately 800° C.–900° C. for one to two hours under a vacuum atmosphere below $10^{-2}$ Torr.

13. A method for manufacturing a part according to claim 7; wherein the step of fabricating a part is a cold compaction die method.

14. A method for manufacturing a part according to claim 13; further comprising the step of adding a lubricant to the ball-milled mixture in an amount of 0.5–1 wt % for improving the compactibility of the ball-milled mixture.

15. A method for manufacturing a part according to claim 13; further comprising the step of heating the compacted product to a temperature of 500° C.–600° C. under a partially reducing atmosphere to remove the lubricant; sintering the compacted product at a temperature between 1220° C. –1300° C. in a vacuum of $10^{-2}$ Torr or lower; and performing a hot isostatic pressing without canning.

16. A method for manufacturing a part according to claim 7; wherein the step of fabricating a part is a cold isotropic pressing method.

17. A method for manufacturing a part according to claim 16; further comprising the step of adding a lubricant to the ball-milled mixture in an amount of 0.5–1 wt % for improving the compactibility of the ball-milled mixture.

18. A method for manufacturing a part according to claim 16; further comprising the step of heating the compacted product to a temperature of 500° C. –600° C. under a partially reducing atmosphere to remove the lubricant; sintering the compacted product at a temperature between 1220° C. –1300° C. in a vacuum of $10^{-2}$ Torr or lower; and performing a hot isostatic pressing without canning.

19. A method for manufacturing a part according to claim 7; wherein the heat treatment step comprises the steps of heating above the austenizing temperature for a predetermined time, and cooling the part by one of oil-quenching and air-cooling.

* * * * *